US009373921B1

(12) United States Patent
Lin

(10) Patent No.: US 9,373,921 B1
(45) Date of Patent: Jun. 21, 2016

(54) SOCKET DEVICE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 14/613,156

(22) Filed: Feb. 3, 2015

(51) Int. Cl.
*H01R 13/72* (2006.01)
*H01R 25/00* (2006.01)
*H01R 13/70* (2006.01)

(52) U.S. Cl.
CPC ..... *H01R 25/006* (2013.01); *H01R 13/70* (2013.01)

(58) Field of Classification Search
CPC ..... H01R 11/00; H01R 25/003; H01R 31/06
USPC ..... 439/501, 652, 650, 528
See application file for complete search history.

(56) References Cited

U.S. PATENT DOCUMENTS 4,778,125 A * 10/1988 Hu ..... H02G 11/02 191/12.2 R
5,071,367 A * 12/1991 Luu ..... H01R 13/72 191/12.4
5,931,702 A * 8/1999 Fladung ..... H01R 13/6392 439/369
6,179,665 B1 * 1/2001 Rossman ..... H01R 13/72 439/131
7,988,494 B2 * 8/2011 Lee ..... H01R 13/713 439/652

* cited by examiner

*Primary Examiner* — Phuong Dinh
(74) *Attorney, Agent, or Firm* — WPAT, P.C., Intellectual Property Attorneys; Anthony King

(57) ABSTRACT

A socket device comprises a socket body including a swerve part, wherein a first socket part extends from an end of the swerve part and a second socket part extends from the other end of the swerve part, an electric power line extends from the interior of the swerve part, an accommodation groove is configured on the lateral wall of the socket body where the electric power line extends out thereby accommodating and attaching the electric power line into the accommodation groove to achieve the objective of electric power line accommodation; meanwhile, the first socket part and the second socket part extending from the two ends of the swerve part can further improve the application flexibility of the socket device.

10 Claims, 5 Drawing Sheets

SOCKET DEVICE

BACKGROUND OF THE INVENTION

1. Field of the Invention

The present invention generally relates to a socket device; in particular, it relates to a socket device configuring a socket body as having a "┌"-like shape, which is suitable for locations such as a wall corner, foot of a table or any other occasions exhibiting a turning point thereby providing the feature of electric power line accommodation and improved socket application flexibility.

2. Description of Related Art

In currently available extension line sockets, it is common that an electric power line extends from an end of the extension line socket, and an end of the electric power line has an electric power plug. Therefore, in use, the electric power plug of the electric power line can be inserted into an electric power socket on a wall surface in order to provide the extension line socket with electric power.

However, since most of such conventional extension line sockets do not provide the feature of power line accommodation, the electric power line extending from the interior of the extension line socket may be randomly tied up or simply fall out on the floor, which can become quite messy and disordered if the electric power line is excessively long thus leading to inconvenience in application. Besides, most users place the extension line socket directly on the floor, so that, in case the electric power line is overly long without being properly arranged, hazardous events may occur upon pulling it out due to unintentional touches or stumbles by pets or children.

Hence, it would be an optimal solution if it is possible to configure a structure on the socket device which enables the feature of electric power line accommodation and also allows the electric power line placement along different directions upon pulling out the electric power line so that the socket device can be set up at different locations.

SUMMARY OF THE INVENTION

A socket device, comprising: a socket body including a swerve part, wherein a first socket part extends from an end of the swerve part and a second socket part extends from the other end of the swerve part, at least one electric power socket being installed respectively on the first socket part and the second socket part; an electric power line extending from the interior of the socket body conducts external electric power to the first socket part and the second socket part and outputs electric power by way of the electric power sockets; an accommodation groove is configured and connected through on the same lateral walls of the swerve part, the first socket part and the second socket part as the power line, the length of the accommodation groove being equal to the length of the swerve part, the first socket part and the second socket part; and the two ends of the accommodation groove in the first socket part and the second socket part are both open ends so that, upon accommodating and attaching the electric power line into the accommodation groove, it stretches out via the open ends of the accommodation groove in the first socket part and the second socket part.

In a preferred embodiment, at least one electric power switch is installed on the swerve part in order to control the electric power output of the electric power socket on the first socket part and the second socket part.

In a preferred embodiment, the first socket part includes at least one electric power socket allowing alternative current (AC) output.

In a preferred embodiment, the first socket part includes at least one electric power socket allowing direct current (DC) output. The electric power socket is a USB port.

In a preferred embodiment, the second socket part includes at least one electric power socket allowing AC output.

In a preferred embodiment, the electric power line stretches out of the socket body from the accommodation groove of the swerve part, and the stretch-out position is located at the through point in the accommodation groove of the swerve part, the first socket part and the second socket part.

In a preferred embodiment, an opening is formed toward the ground at a position in the swerve part which corresponds to the stretch-out position of the electric power line, and such an opening facilitates positioning the electric power line bended toward the ground in fixation.

In a preferred embodiment, the angle of the swerve part is within a range of 80~100 degrees. Preferably, the angle of the swerve part is 90 degrees such that the first socket part and the second socket part are mutually perpendicular thereby exhibiting a "┌" shape in the socket body, which is suitable for locations such as a wall corner, foot of a table or any other occasions exhibiting a turning point.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Other technical contents, aspects and effects in relation to the present invention can be clearly appreciated through the detailed descriptions concerning the preferred embodiments of the present invention in conjunction with the appended drawings.

Figure 1A:
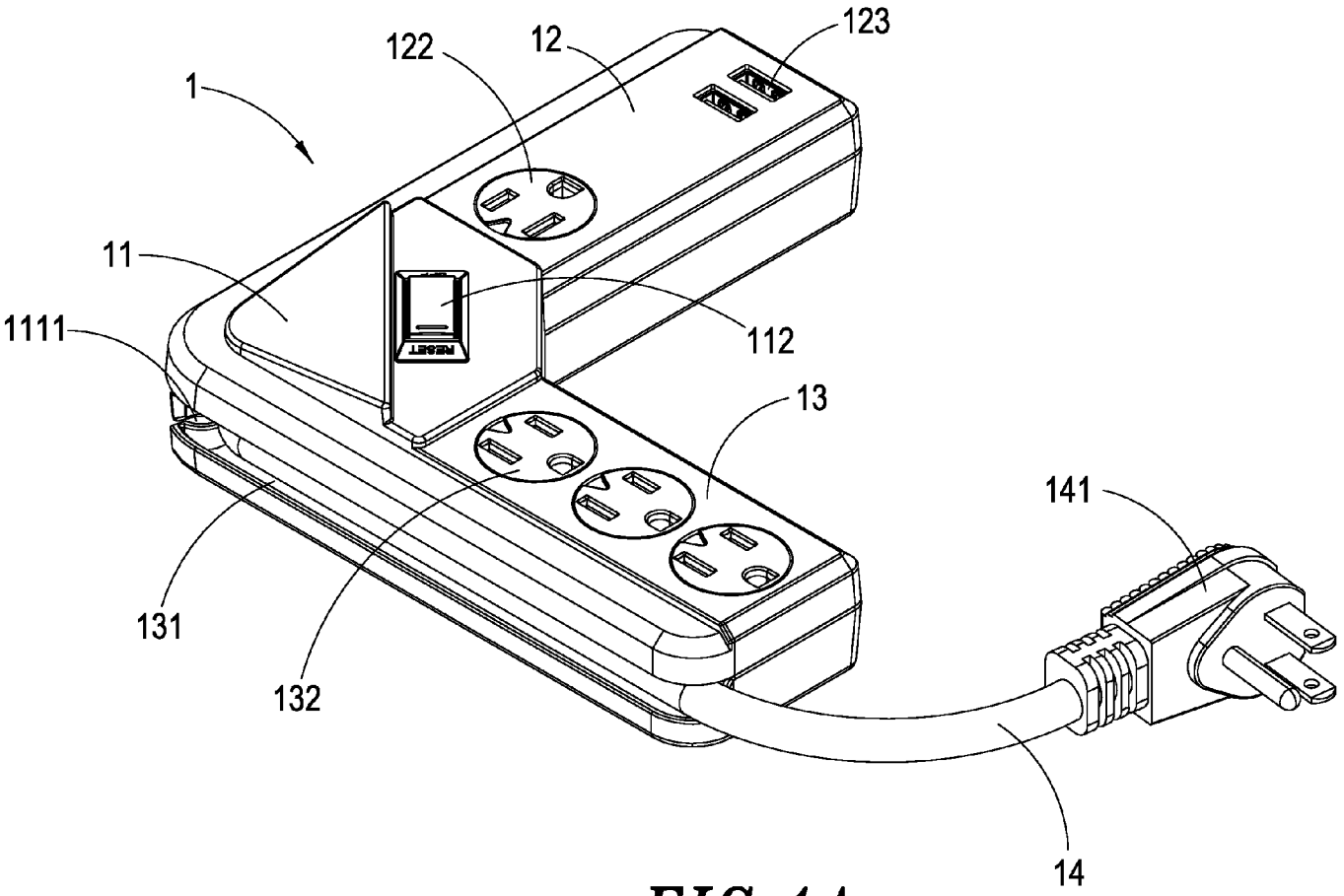
FIG. 1A shows a stereo architecture view of the socket device according to the present invention.

FIG. 1A shows a stereo architecture view of the socket device according to the present invention. It can be appreciated from the Figure that the socket device according to the present invention comprises a socket body 1 including a swerve part 11, wherein a first socket part 12 extends from an end of the swerve part 11 and has the electric power socket 122 for alternative current (AC) output as well as the electric power socket for direct current (DC) output, in which the electric power socket for DC output is a USB port 123, and the surface of the swerve part 11 has an electric power switch 112; meanwhile, a second socket part 13 extends from the other end of the swerve part 11 which includes the electric power socket 132 for AC output, and the electric power socket for DC output can be optionally configured on the second socket part 13 in accordance with user's demand, which may be a USB port (not shown). Furthermore, it can be understood from the Figure that a certain angle can be formed between the first socket part 12 and the second socket part 13 (here in FIG. 1A the angle between the first socket part 12 and the second socket part 13 is within a range of 80~100 degrees, preferably at 90 degrees; but the angle between the first socket part 12 and the second socket part 13 can be differently configured.) The electric power switch 112 on the swerve part controls whether the electric power is outputted by way of the first socket part 12 and the second socket part 13.

Figure 1B:
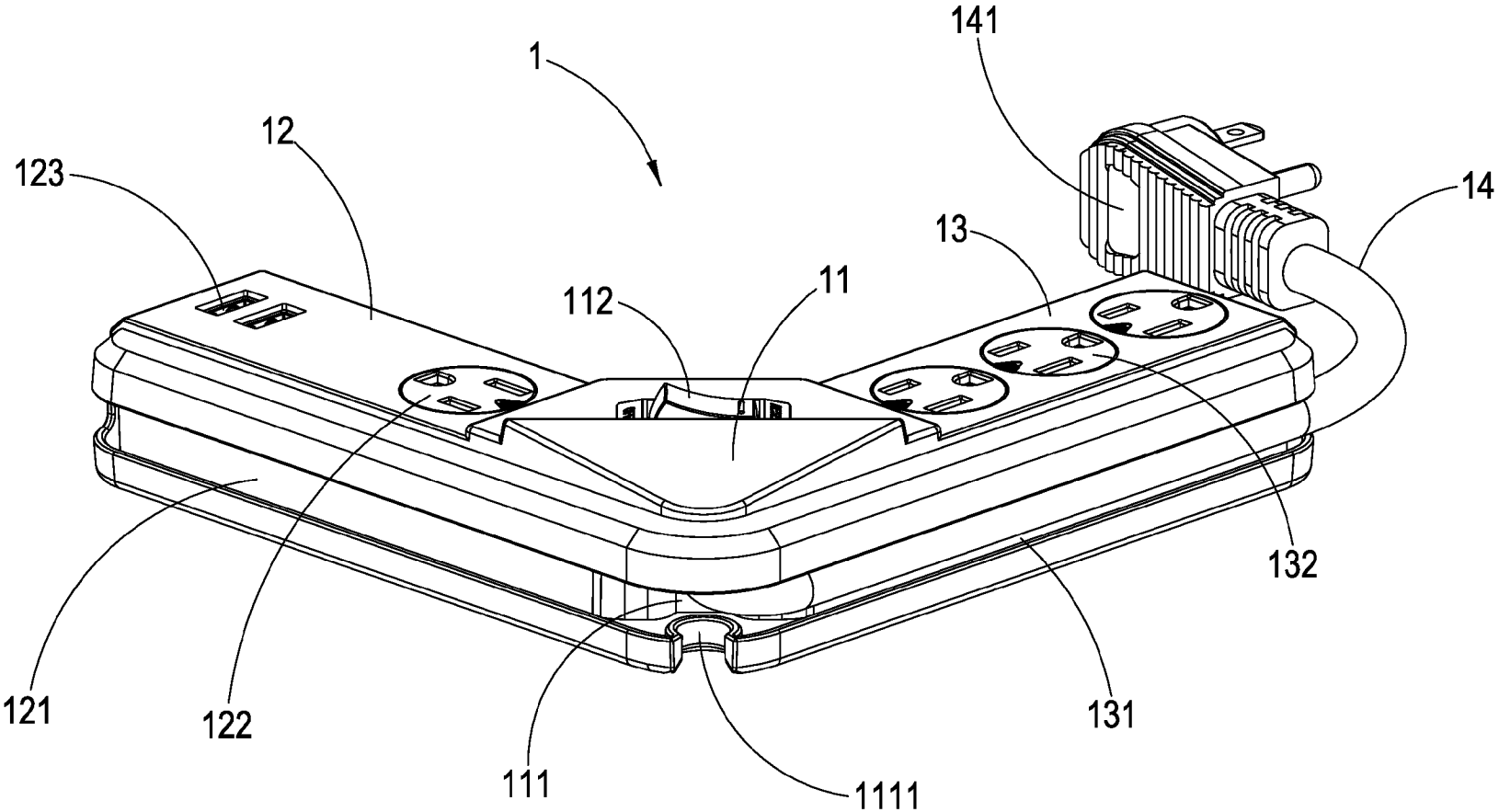
FIG. 1B shows a stereo architecture view of the socket device according to the present invention, which is seen at another angle.

From FIG. 1B, it can be seen that an electric power line 14 having an electric power plug 141 extends from the interior of the swerve part 11, and there includes the accommodation groove 121, 111, 131 connected through on the lateral walls of the first socket part 12 and the second socket part 13 where the electric power line 14 stretches out. The length of the accommodation groove 121, 111, 131 is equal to the length of the swerve part 11, the first socket part 12 and second socket part 13, and the ends of the accommodation groove on the lateral walls of the first socket part 12 and second socket part 13 are open ends such that the electric power line 14 can be attached within the accommodation groove 121, 111, 131. In addition, it can be appreciated from the Figure that, after extending out from the interior of the swerve part 11, the electric power line 14 can be attached to the accommodation groove 111, move toward the accommodation groove 131 of the second socket part 13, and ultimately extend out from the open end of the accommodation groove 131 in the second socket part 13.

Figure 1C:
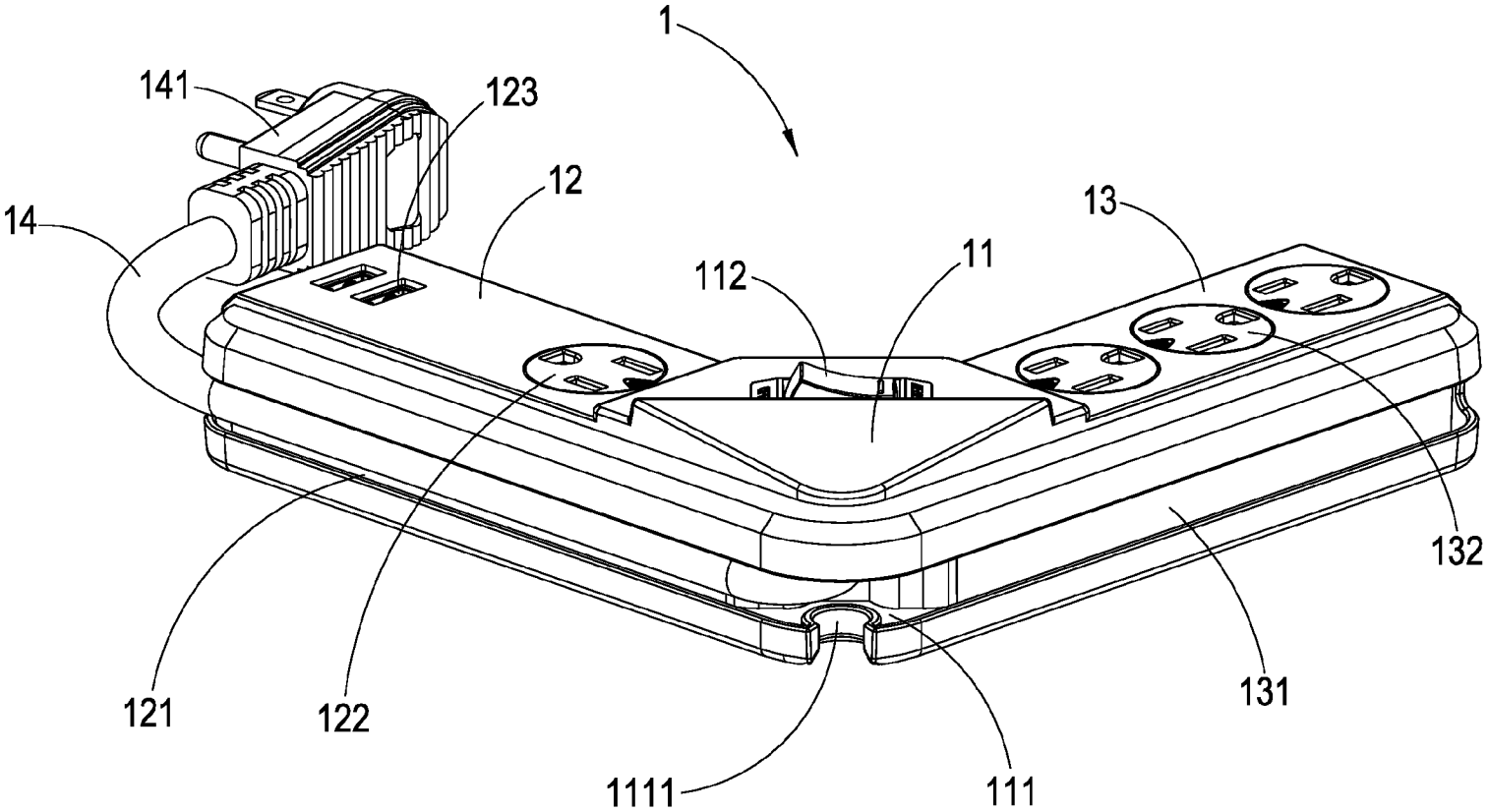
FIG. 1C shows a view of the socket device according to the present invention, in which the electric power line is set up on the other side.

In FIG. 1C, it is shown that the electric power line 14 can be alternatively attached toward the other side as well, and it can be appreciated that, after coming out from the interior of the swerve part 11, the electric power line 14 can be attached to the accommodation groove 111 in the swerve part 11, move toward the accommodation groove 121 of the second socket part 12, and finally extend out from the open end of the accommodation groove 121 in the first socket part 12.

Figure 3:
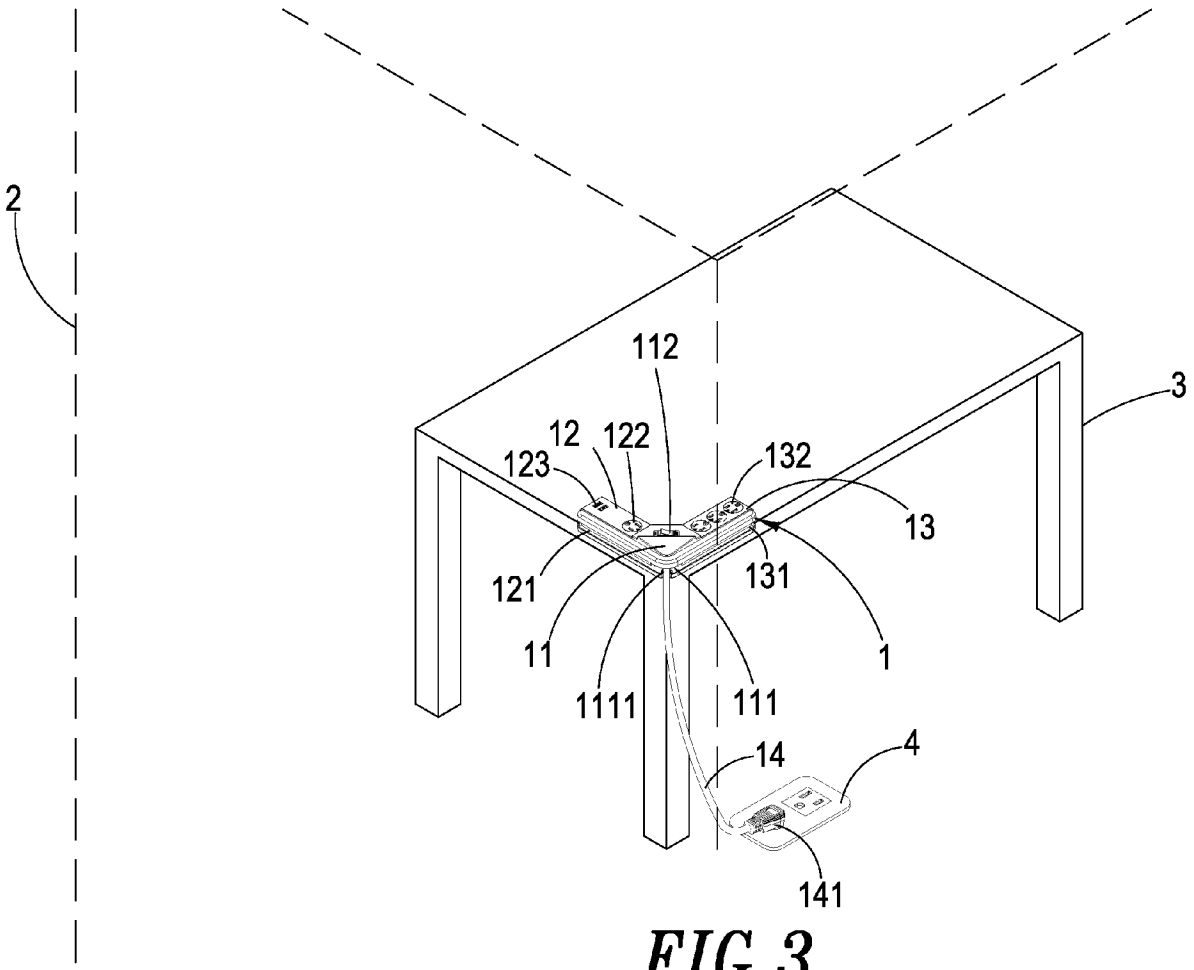
FIG. 3 shows a view for a second embodiment of the socket device according to the present invention.

Moreover, it can be seen from FIG. 1C that an opening 1111 is formed at a position toward the ground in the accommodation groove 111 on the lateral wall of the swerve part 11, as shown in FIG. 3, so that the electric power plug 141 of the electric power line 14 can be positioned in the opening 1111 upon facing the ground.

Figure 2:
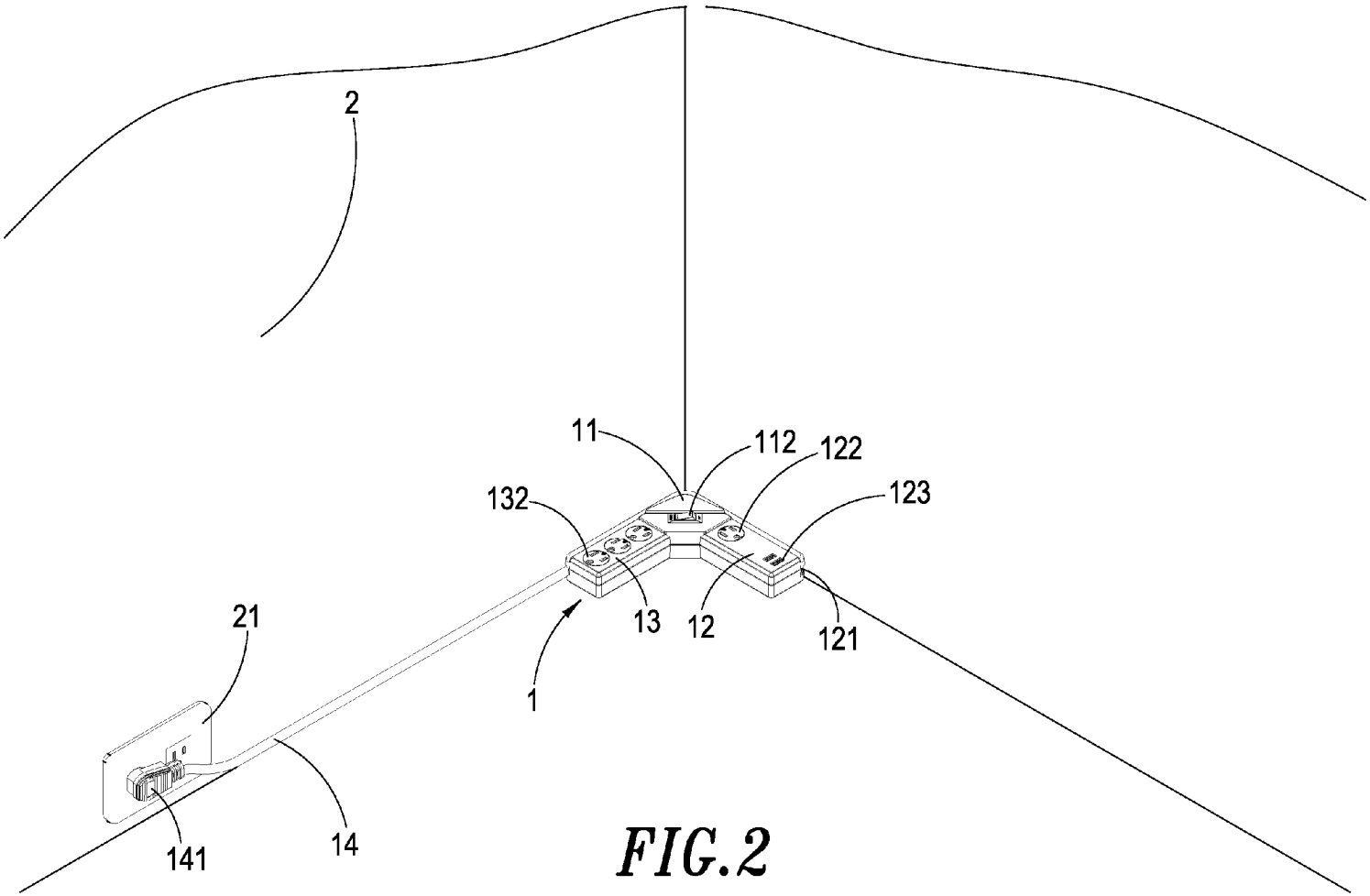
FIG. 2 shows a view for a first embodiment of the socket device according to the present invention.

A first embodiment of the present invention is shown in FIG. 2, wherein the socket body 1 is placed at a wall corner, the wall surface 2 has an electric power socket 21, the electric power line 14 of the socket body 1 placed at the wall corner is attached to the accommodation groove 111, 131 and ultimately extends out from the open end of the accommodation groove 131 in the second socket part 13, and the electric power plug 141 of the electric power line 14 is inserted into the electric power socket 21 such that electric power can be conducted to the sockets on the first socket part 12 and second socket part 13 via the electric power line thus enabling electric power output by means of the electric power socket.

In addition, a second embodiment of the present invention is shown in FIG. 3, wherein the socket body 1 is placed on a table 3 which is settled against the wall surface 2, and the electric power socket 4 is arranged on the floor under the socket body 1 so that the electric power line 14 extending from the interior of the swerve part 11 can be also snapped in fixation into the opening 1111 to move toward the ground; hence, the electric power plug 141 of the electric power line 14 can be inserted into the electric power socket 4 to supply electric power to the socket body 1.

Compared with other conventional technologies, the socket device according to the present invention provides the following advantages:

The present invention configures a structure on the socket device which enables the feature of electric power line accommodation and also allows the electric power line placement along different directions upon pulling out the electric power line, thereby that the socket device can be set up at different locations conveniently in accordance with user's needs.

The present invention has been disclosed through the detailed descriptions of the aforementioned embodiments, but such illustrations are by no means used to restrict the present invention Skilled ones in relevant fields of the present invention can certainly devise any applicable alternations and modifications after comprehending the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A socket device, comprising:

a socket body including a swerve part, wherein a first socket part extends from an end of the swerve part and a second socket part extends from the other end of the swerve part, at least one electric power socket being installed respectively on the first socket part and the second socket part; an electric power line extending from the interior of the socket body conducts external electric power to the first socket part and the second socket part and outputs electric power by way of the electric power sockets; an accommodation groove is configured and connected through on the same lateral walls of the swerve part, the first socket part and the second socket part as the power line, the length of the accommodation groove being equal to the length of the swerve part, the first socket part and the second socket part; and the two ends of the accommodation groove in the first socket part and the second socket part are both open ends so that, upon accommodating and attaching the electric power line into the accommodation groove, it stretches out via the open ends of the accommodation groove in the first socket part and the second socket part.

2. The socket device according to claim 1, wherein at least one electric power switch is installed on the swerve part in order to control the electric power output of the electric power socket on the first socket part and the second socket part.

3. The socket device according to claim 1, wherein the first socket part includes at least one electric power socket allowing alternative current (AC) output.

4. The socket device according to claim 1, wherein the first socket part includes at least one electric power socket allowing direct current (DC) output.

5. The socket device according to claim 4, wherein the electric power socket is a USB port.

6. The socket device according to claim 1, wherein the second socket part includes at least one electric power socket allowing AC output.

7. The socket device according to claim 1, wherein the electric power line stretches out of the socket body from the accommodation groove of the swerve part, and the stretch-out position is located at the through point in the accommodation groove of the swerve part, the first socket part and the second socket part.

8. The socket device according to claim 7, wherein an opening is formed toward the ground at a position in the accommodation groove of the swerve part which corresponds to the stretch-out position of the electric power line, and such an opening facilitates positioning the electric power line bended toward the ground in fixation.

9. The socket device according to claim 1, wherein the angle of the swerve part is within a range of 80~100 degrees.

10. The socket device according to claim 1, wherein the angle of the swerve part is 90 degrees such that the first socket part and the second socket part are mutually perpendicular thereby exhibiting a "ㄱ" shape in the socket body.

* * * * *